US007254863B1

(12) United States Patent
Morad

(10) Patent No.: US 7,254,863 B1
(45) Date of Patent: Aug. 14, 2007

(54) SINGLE ACTION MOP WRINGER

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 578 days.

(21) Appl. No.: 10/781,110

(22) Filed: Feb. 17, 2004

(51) Int. Cl.
*A47L 13/60* (2006.01)

(52) U.S. Cl. ..... 15/262; 15/260

(58) Field of Classification Search ..... 15/260, 15/262

See application file for complete search history.

(56) References Cited

U.S. PATENT DOCUMENTS 4,135,269 A * 1/1979 Marston ..... 15/4
6,487,749 B1 * 12/2002 Tsui ..... 15/262

* cited by examiner

*Primary Examiner*—Randall Chin
(74) *Attorney, Agent, or Firm*—Thomas I. Rozsa

(57) ABSTRACT

A single action mop wringer which is formed of a housing having oppositely disposed sidewalls therein which have a pair of aligned spaced apart tracks in each sidewall which provide a guide for pins rollably supporting a pair of spaced apart rollers to come together at a desired distance to wring water from a mop on a single pass.

6 Claims, 4 Drawing Sheets

SINGLE ACTION MOP WRINGER

BACKGROUND OF THE INVENTION

1. Field of the Invention

The present invention generally relates to the field of mop wringers which are used to wring water out of a mop which has threads of yarn. More particularly, the present invention relates to the field of hand-operated mop wringers which are used to wring water out of yarn mops.

2. Description of the Prior Art

Mop wringers are used for wringing mops. The majority of mop wringers currently used in general households and ordinary businesses or institutions are hand operated. A hand-operated mop wringer is usually mounted on top of a small water bucket or basket. A user can rinse a mop in the water basket and then drain the mop with the mop wringer.

A conventional hand-operated mop wringer typically includes a housing which can be mounted on top of the small water basket. The housing supports two wringer plates. The two wringer plates are oppositely disposed and spring biased in a spaced apart relationship. Each wringer plate has a plurality of small apertures for draining the water. The housing further supports a mechanism which can drive the two wringer plates moving toward each other.

The driving mechanism can be operated through a wringer handle. The wringer handle is pivotably mounted at its lower end to the housing.

To drain a mop with the mop wringer, a user first places the mop between the two wringer plates, then pushes down the upper end of the wringer handle. Each time the upper end of the wringer handle is pressed, the two wringer plates will move towards each other and squeeze the mop. When the upper end of the wringer handle is released the two wringer plates will separate and the wringer handle swings back. The user can then remove the mop from the wringer.

A significant disadvantage of mop wringers known in the prior art is that the effectiveness of the conventional hand-operated mop wringer depends on the strength of the user. To drain the mop more effectively, the user needs to push the wringer handle down harder. How hard the wringer plates squeeze the mop depends on how hard the user pushes the wringer handle. A user with less strength often has to repeat the operation several times as desired. Furthermore, the user often needs to operate the wringer handle repeatedly to drain the mop as desired.

These drawbacks of the conventional mop wringer are very undesirable for people with less physical strength, especially elderly people. Even for people with normal strength, the awkward and laborious operation of the mop wringer increases their fatigue very rapidly.

The present inventor Fred I. Morad attempted to address these issues by the creation of a semi-automatic mop wringer which was disclosed and claimed in U.S. Pat. No. 5,274,877 which issued on Jan. 4, 1994. While the invention was a very fine innovation, the complicated mechanism was expensive to produce and was not commercially viable.

Therefore, there is a significant need for improvements in mop wringers which address the problems discussed above but at the same time is embodied in a simpler mechanical device which will be commercially viable to manufacture and sell.

SUMMARY OF THE INVENTION

The present invention is a single action mop wringer which is formed of a housing having oppositely disposed sidewalls therein which have a pair of aligned spaced apart tracks in each sidewall which provide a guide for pins rollably supporting a pair of spaced apart rollers to come together at a desired distance to wring water from a mop on a single pass.

An activation means which can be a horizontal platform, yoke assembly or similar type of apparatus is movably connected to the pins supporting the rollers and a downward force on the handle incorporated into the activation means causing said rollers to move along the tracks.

A return spring will cause the activation means and the rollers to return to their original starting positions after the downward force on the handle is removed.

It is therefore an object of the present invention to provide a mop wringer where a single downward force causes rollers to come together at a desired distance so that the rollers will wring water out of mop strands placed between the rollers before they are caused to come together.

It is a further object of the present invention to provide a mop wringer which will wring water in a single pass without requiring multiple wringing operations.

It is a further object of the present invention to provide a mop wringer where only a minor force is required to cause the handle to move downwardly and activate the mop wringers to come together.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
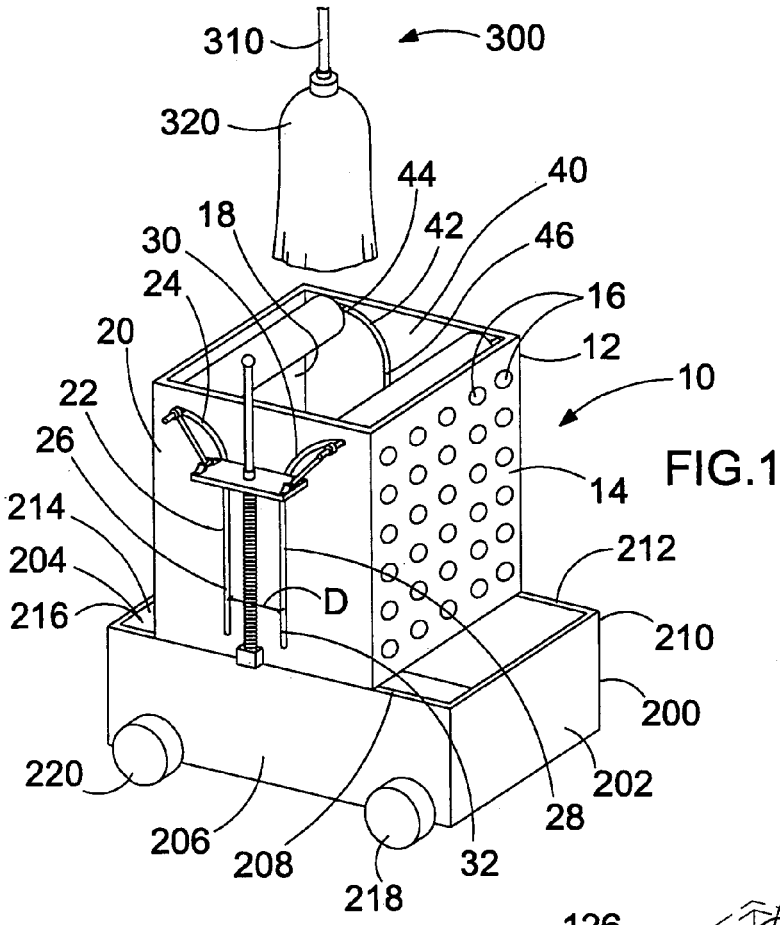
FIG. 1 is a perspective view of a first embodiment of the present invention single action mop wringer, shown resting on a bucket with the yarn mop held above the present invention.

Referring to FIG. 1, there is illustrated a perspective view of a first embodiment of the present invention single action mop wringer 10 which is resting on a rectangular conventional water bucket 200.

The water bucket 200 is comprised of four vertical walls, a front wall 202, a rear wall 204, a first sidewall 206 having a top edge 208 and a parallel spaced apart second sidewall 210 having a top edge 212. There is also a bottom 214. The bottom 214, front wall 202, rear wall 204, first sidewall 206 and second sidewall 210 surround an internal cavity 216 which can retain water. Preferably, the water bucket is rollable, and comprises a pair of parallel spaced apart front wheels of which one 218 is shown and a pair of parallel spaced apart rear wheels of which one 220 is shown.

Figure 2:
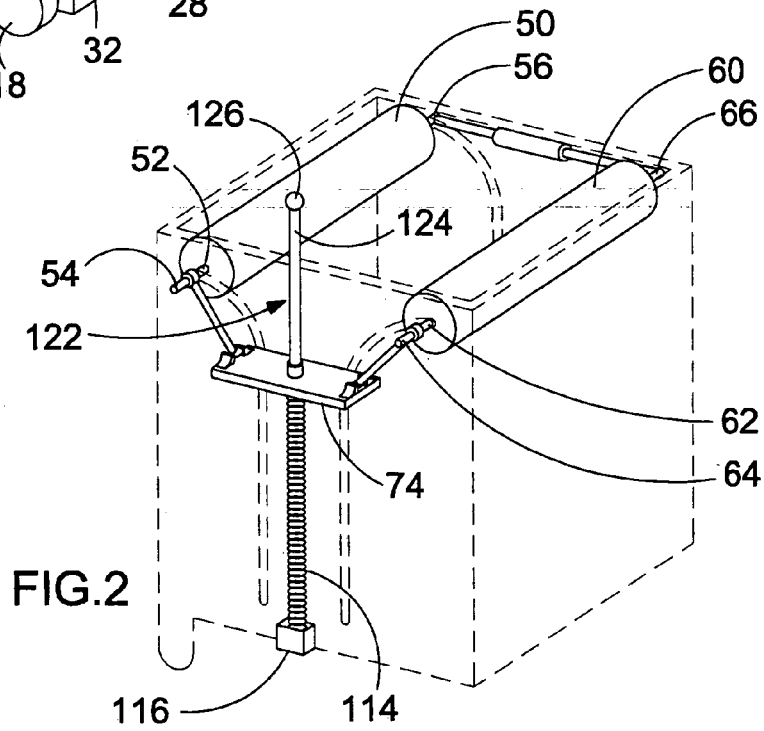
FIG. 2 is an illustrative perspective view of the operating components of the first embodiment of the present invention single action mop wringer.

Referring to FIGS. 1 and 2, there is shown the first embodiment of the present invention single action mop wringer 10 comprising a housing 12 and front wall 14 having a multiplicity of openings 16, a generally parallel and spaced apart rear wall 18 which may also have a multiplicity of openings (not shown), a first sidewall 20 and a parallel and spaced apart second sidewall 40. The first sidewall 20 comprises a first channel 22 having an arcuate upper section 24 and a vertically aligned second section 26 and a spaced apart second channel 28 having an arcuate upper section 30 which is a mirror image of the upper section 24 and a vertically aligned second section 32 which is spaced apart from and parallel to second section 26. Vertically aligned second sections 26 and 32 are spaced apart by a distance "D". Second sidewall 40 has channels which are parallel to and correspond with the channels in first section 20, only one of which is shown. Second sidewall 40 comprises a first channel 42 having an arcuate upper section 44 and a vertically aligned second section 46. Arcuate sections 24 and 44 are parallel and aligned. Vertical sections 26 and 46 are also parallel and aligned. Second sidewall 40 also has a second channel with an arcuate section which is a mirror image of the arcuate section 44 and a vertically aligned second section which is parallel to vertically aligned section 46 and spaced apart therefrom by a distance "D". The arcuate section of the second channel in sidewall 40 is parallel and aligned with arcuate section 30. The vertically aligned section of the second channel in sidewall 40 is parallel and aligned with vertical section 32.

The single action mop wringer 10 comprises a pair of spaced apart rollers which are used to squeeze water from a mop. First roller 50 is supported on and rotates about a central pin 52 having a first end 54 and a second end 56. Second roller 60 is supported on central pin 62 having a first end 64 and a second end 66. Pin 52 extends through channels 22 and 42 and travels along the channels. Pin 62 extends through channel 28 and the corresponding second channel in second sidewall 40 and travels along the channels.

A horizontally aligned movable platform 70 is positioned adjacent first sidewall 20. In the first embodiment of the present invention single action mop wringer 10, the movable platform 70 is movably supported by a pair of pivotable arms. The movable platform 70 and pivotable arms are shown in greater detail in FIGS. 3 and 4. The movable platform 70 has a horizontal top surface 72. First arm 76 has an elongated shaft 78 terminating in a base 80 having a pair of pins 81 and 82 which are rotatably supported in a first bracket 84 affixed to the top surface 72 of movable platform 70 and located adjacent one end of the movable platform 70. The bracket 84 has a first wall 86 with an opening 87 to rotatably accommodate pin 81 and a second wall 88 with an opening 89 to rotatably accommodate pin 82. At its opposite end, elongated shaft 78 and first arm 76 terminate in a collar 90 having an opening 92. Second arm 96 also has an elongated shaft 98 terminating in a base 100 having a pair of pins 101 and 102 which are rotatably supporting second bracket 104 affixed to the top surface 72 of movable platform 70 and located at the end of platform 70 opposite from the location of first bracket 84. The second bracket 104 has a first wall 106 with an opening 107 to rotatably accommodate pin 101 and a second wall 108 with an opening 109 to rotatably accommodate pin 102. At its opposite end shaft 98 of second arm 96 terminates in a collar 110 having an opening 112. Brackets 84 and 104 are parallel to each other so that arms 76 and 96 will rotate in the same plane.

Figure 4:
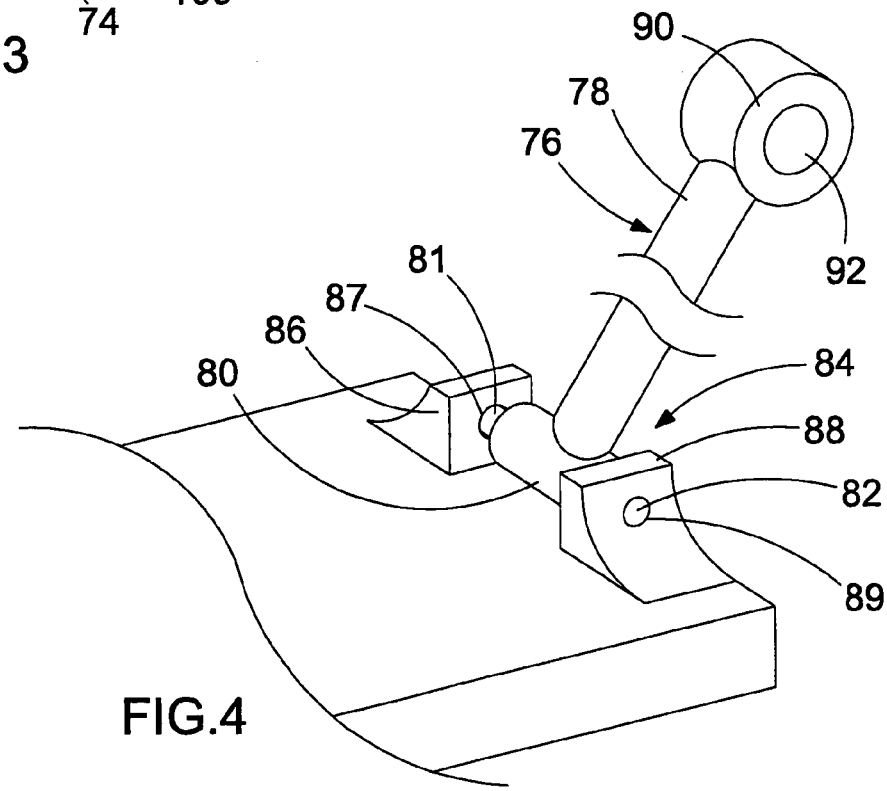
FIG. 4 is an enlarged view of one of the arm holders of the first embodiment of the present invention.

Referring to FIG. 4, the first arm 76 is shown rotatably inserted into first bracket 84. It will be appreciated that second arm 96 is rotatably inserted into second bracket 104 in the same way.

Figure 5:
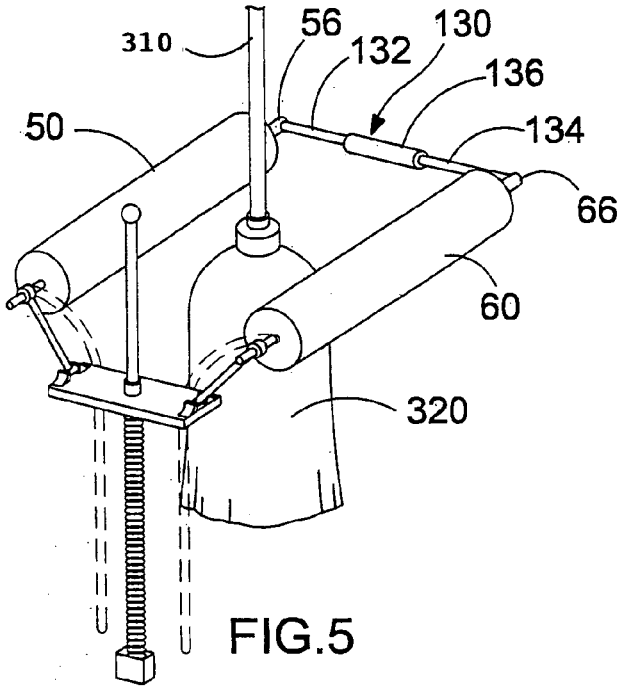
FIG. 5 is an operational view of the first embodiment of the present invention showing the mop yarn inserted between the pair of rollers.

Referring to FIGS. 1, 2 and 5, the movable platform 70 is supported in the following manner. The platform 70 as illustrated in FIGS. 1, 2, 5, 6 and 7 is rotated 180 degrees in the horizontal plane from the view illustrated in FIG. 3. Collar 90 is rotatably affixed to central pin 52 by having opening 92 inserted through first end 54 of central pin 52 and retained thereon by conventional means such as a clip or cotter pin. Similarly, collar 110 is rotatably affixed to central pin 62 by having opening 112 inserted through first end 64 of central pin 62 and retained thereon by conventional means such as a clip or cotter pin.

A return spring 114 is affixed to the lower surface 74 of movable platform 70 and the return spring is supported at its opposite end by a spring base 116 affixed to first sidewall 20 adjacent its lower end. While only one return spring 114 is shown, it will be appreciated that a pair of return springs or any multiplicity of return springs can be incorporated into the present invention. When only one return spring 114 is used as illustrated in the figures, it is preferably centrally positioned on lower surface 74 of movable platform 70.

Upper surface 72 of movable platform 70 also has a centrally positioned handle base 118 having internal threads 120. A platform handle 122 is comprised of an elongated shaft 124 having a grip member 126 at one end and mating threads at its lower end to be threaded into the handle base.

At the ends of the rollers 50 and 60 opposite to where the arms 76 and 96 are attached, the pins 52 and 62 are connected by a flexible tie bar having an internal spring so that the length of the tie bar can be varied. Referring to FIGS. 2 and 5, tie bar 130 has two shafts 132 and 134 which are connected at the interior ends by a collar 136 having an internal spring (not shown) to which each internal end of shafts 132 and 134 are connected. At its outer end, shaft 132 is rotatably connected to rear end 56 of pin 52 and at its outer end, shaft 134 is rotatably connected to rear end 66 of pin 62. The tie bar 130 is just outside second sidewall 40.

The operation of the first embodiment of the present invention single action mop wringer will now be described. Referring to FIGS. 1 through 7, initially, the housing 12 is placed onto the water bucket 200 as illustrated in FIG. 1 so that the lower edges of sidewalls 20 and 40 respectively rest on the top edge 208 of first sidewall 206 and the top edge 212 of second sidewall 210 of water bucket 200.

Figure 6:
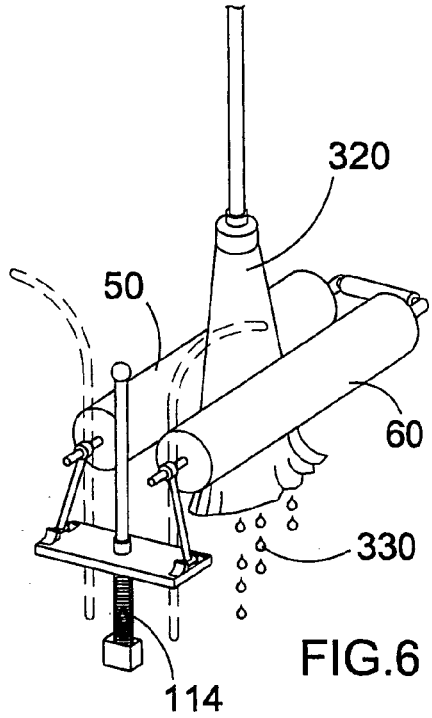
FIG. 6 is a second operational view of the first embodiment of the present invention showing the two rollers activated and caused to come together to squeeze water out of the mop yarn.

The water bucket 200 may have its interior cavity 216 partially filled with water so that the mop 300 may have the mop strands 320 initially rinsed. The mop 300 comprises a handle 310 and strands 320 which are conventionally made of yarn or other fiber material. The mop 300 is then held above the mop ringer 10 as illustrated in FIG. 1. To begin the operation the mop is inserted into the housing as illustrated in FIG. 5 so that the mop strands 320 are below the pair of rollers 50 and 60 while the mop handle 310 is held above the rollers 50 and 60 so that it will not interfere with the operation of the rollers. With the other hand the grip member 126 of the handle 122 is grasped and a downward force is placed on it so that the movable horizontal platform 70 is caused to move downwardly. This downward action causes arm 76 to cause pin 52 to move along first channel 22 which serves as a track and simultaneously causes arm 96 to cause pin 62 to move along second channel 28 which also serves as a track, and concurrently, pin 52 moves along first channel 42 and pin 62 moves along the corresponding second channel in second sidewall 40 so that the pins 52 and 62 move from the respective arcuate sections of the channels to the vertical sections of the channels. This action causes the rollers 50 and 60 to come together as illustrated in FIG. 6 and rotatably travel down the length of the mop strands 320 to wring water 330 from the mop strands.

Figure 7:
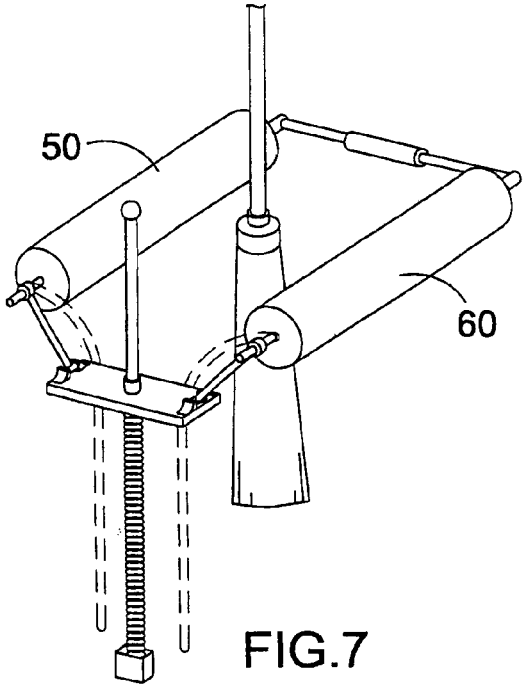
FIG. 7 is a third operational view of the first embodiment of the present invention showing the rollers returning to their original starting position after the water has been wrung out of the mop.

The distance "D" between the vertical sections of the channels is selected so that the rollers 50 and 60 will be at a proper separation to properly wring water from the mop strands 320. As water 330 is wrung out of the mop strands, the water exits through openings 16 in housing 12 and also fall through the open bottom of the housing 12 and into the interior chamber 216 of water bucket 200. As also illustrated in FIG. 6, as the movable platform 70 is caused to move downwardly, the tie bar 130 is compressed as the shafts 132 and 134 are compressed together and compress the internal spring inside collar 136. Also, return spring 114 is compressed as illustrated in FIG. 6. After water 330 has been wrung from the mop strands 320 by the single downward motion, the downward force on the platform handle 122 is released. The compressed return spring 114 then exerts an upward force as illustrated in FIG. 7 to return the horizontal platform 70 to its original position as illustrated in FIG. 1 and the pins 52 and 62 respectively move along channels 22 and 28 to all return to their original position as illustrated in FIG. 1, thereby causing rollers 50 and 60 to separate, as illustrated in FIG. 7. Since the rollers 50 and 60 are positioned to completely wring the mop strands 320 dry after only one downward pull, the present invention is far more efficient than prior art mop wringers. It is not necessary to wring the mop over and over and no extra heavy force is required to squeeze the mop strands 320 since the channels or tracks cause the rollers 50 and 60 to come together by the predetermined distance "D" to fully wring the mop strands 320 dry on a single pass.

Figure 8:
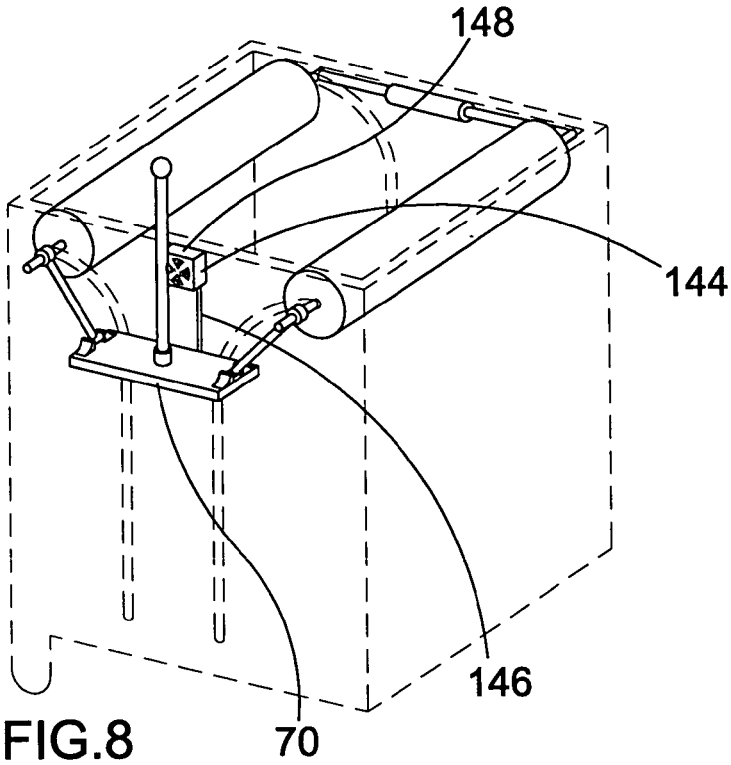
FIG. 8 is an illustrative perspective view of the operating components of a second embodiment of the present invention single action mop wringer.

The second embodiment of the present invention single action mop wringer is illustrated in FIG. 8. The only variation from the first embodiment is the location of the return spring. All of the other components are identical. In the second embodiment, the return spring 144 is positioned above the platform 70. The return spring 144 has a housing 148 which is attached to the first sidewall 20 at a location above the horizontal platform 70 and housing flat spring 146 which is attached to the horizontal platform 70 as illustrated in FIG. 10. The return spring 144 operates like a retractable tape measure. As the platform is caused to move downwardly to cause the rollers 50 and 60 to come together to wring the mop strands 320 dry in the manner previously set forth, the spring 146 is stretched. After the mop strands 320 have been wrung dry, the downward force on the platform handle 122 is released and the return spring force from return spring 144 retracts the spring 146 back into housing 148 causing the horizontal platform to return to its initial position, causing the pins 52 and 62 to move along a return path on the channels 22, 28 42 and corresponding second channel in the second sidewall until the rollers 50 and 60 are returned to their spread apart starting position.

Figure 3:
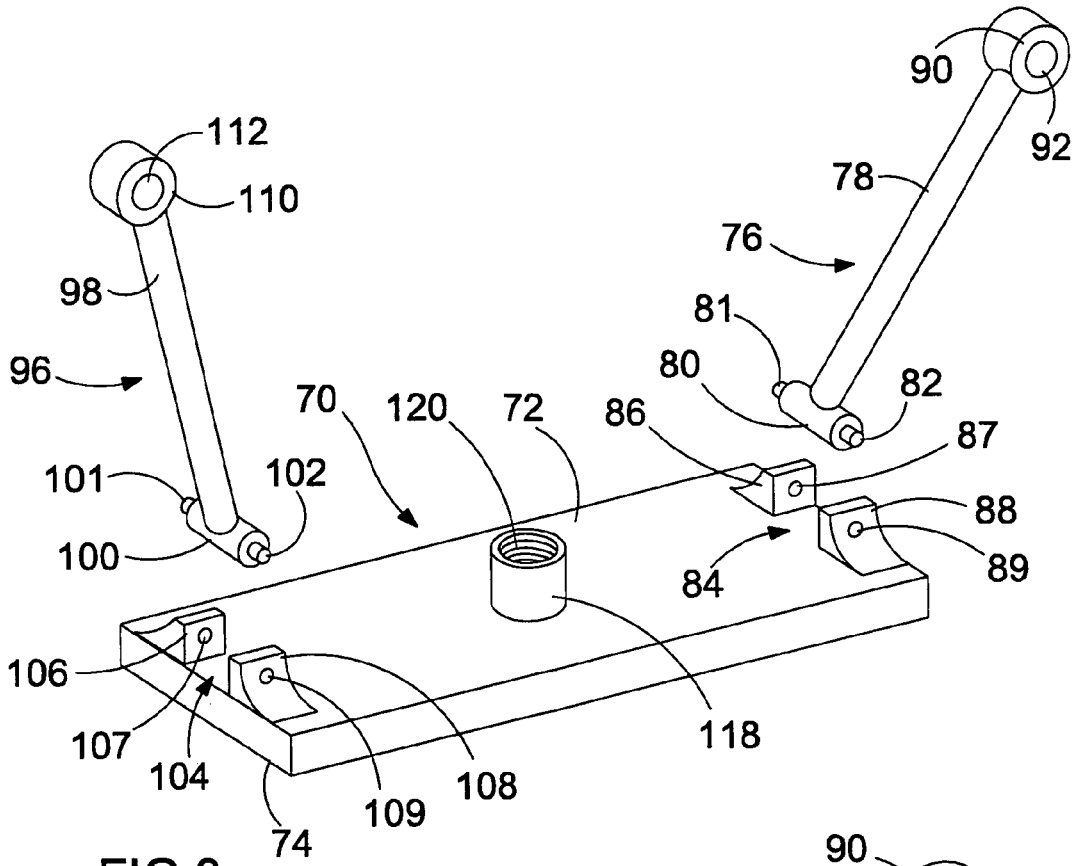
FIG. 3 is an exploded perspective view of the plate and arm holders of the first embodiment of the present invention.
Figure 9:
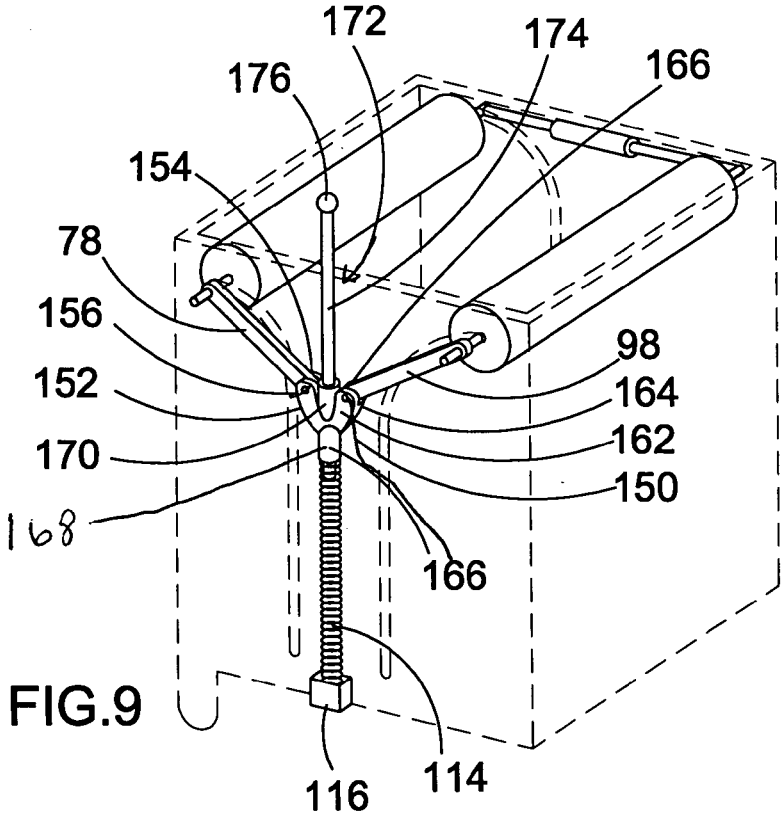
FIG. 9 is an illustrative perspective view of the operating components of a third embodiment of the present invention single action mop wringer.

In the third embodiment, the horizontal platform is replaced with a yoke assembly as illustrated in FIG. 9. The yoke assembly 150 comprises a first generally Y-shaped member having a first section 152 including a gap 154 and aligned openings 156 to receive a portion of first arm 78 and a second section 162 including a gap 164 and aligned openings 166 to receive a portion of second arm 98. The openings 156 in first section 152 can accommodate means to rotatably support the arm 78 in the first section 152 which can be pins 81 and 82 as illustrated in FIG. 3 or a rivet. Similarly, the openings 166 in second section 162 can accommodate means to rotatably support the arm 98 in the second section 162 which can be pins 101 and 102 as illustrated in FIG. 3 or a rivet. The opposite end of arm 78 is rotatably attached to pin 52 in the same manner as illustrated in the previous figures and the opposite end of arm 98 is rotatably attached to pin 62 in the same manner as illustrated in the previous figures. The yoke 150 is attached to a base 168 which in turn is attached to a return spring 114 which in turn is attached to a spring base 116 attached to the first sidewall 22 in the manner previously described.

Supported between first and second sections 152 and 162 of yoke assembly 150 is a handle base 170 with receiving means such as internal threads to receive the handle 172 which has an elongated shaft 174 and a grip member 176 at one end with the opposite end of the shaft received within the handle base 170.

The operation is similar to the operation described for the first embodiment. A downward force on handle 172 causes the yoke assembly 150 to move downwardly and the arms 78 and 98 cause pins 52 and 62 to move along tracks or channels 22 and 28 and the corresponding channel 44 and other channel in second sidewall 40 until the rollers 50 and 60 are brought together to squeeze water from the mop strands 320 and the return spring 114 is compressed. After the mop strands are wrung dry, the downward force is released, the yoke 150 moves upwardly by the upward force of the return spring 114 to return the components to their starting position.

All of the components of the present invention can be fabricated out of plastic, polystyrene, other moldable materials or out of metal such as aluminum or steel.

Defined in detail, the present invention is a single action mop wringer, comprising: (a) a housing including a front wall having a multiplicity of openings, a rear wall, a first sidewall having a lower edge, an upper edge and a parallel oppositely disposed second sidewall having a lower edge and upper edge, and an open top and open bottom; (b) a first channel formed into the first sidewall, the first channel having a first arcuate section extending in one direction toward the rear wall and adjacent the upper edge, and extending in the opposite direction to a first vertically aligned second section terminating at a distance above the lower edge of the first sidewall; (c) a second channel formed into the first sidewall, the second channel having a second arcuate section extending in one direction toward the front wall and the upper edge, and extending in the opposite direction to a second vertically aligned section terminating at a distance above the lower edge of the first sidewall, the first vertically aligned second section and the second vertically aligned second section being spaced apart and parallel to the one and having the same vertical distance from their respective arcuate sections to the distance above the lower edge of the first sidewall; (d) a first channel formed into the second sidewall, the first channel in the second sidewall being the same shape as and parallel to the first channel formed into the first sidewall, the first channel formed into the second sidewall having a corresponding arcuate section and a corresponding vertical section; (e) a second channel formed into the second sidewall, the second channel in the second sidewall being the same shape as and parallel to the second channel formed into the first sidewall, the second channel formed into the second sidewall having a corresponding arcuate section and a corresponding vertical section; (f) a first roller rotatably supported on a pin and adjacent the upper edge of the first and second sidewalls, the pin having a front end and extending through the first arcuate section of the first channel in the first sidewall and a rear end extending through a first arcuate section in the first channel in the second sidewall; (g) a second roller spaced from and parallel to the first roller, the second roller rotatably supported on a pin and adjacent the upper edge of first and second sidewalls, the pin having a front end extending through the second arcuate section of the second channel in the first sidewall and a rear end extending through a second arcuate section in the second channel in the second sidewall; (h) a horizontally aligned movable platform disposed adjacent the first sidewall, the movable platform having a first bracket with an opening adjacent one of its ends and a parallel oppositely disposed second bracket with an opening adjacent its opposite end; (i) a first arm having an elongated shaft and with a base at one end having a pair of oppositely disposed pins which are inserted in and rotatably supported by the opening in the first bracket and a collar with an opening at the opposite end of the shaft, the opening of the collar inserted onto the first end of the pin supporting the first roller; (j) a second arm having an elongated shaft and a base at one end having a pair of oppositely disposed pins which are inserted in and rotatably supported by the opening in the second bracket and a collar with an opening at the opposite end of the shaft, the opening of the collar inserted onto the first end of the pin supporting the second roller; (k) the movable platform having a centrally disposed handle base, an elongated handle supported in the handle base at one end and having a grip member at its opposite end; (l) a spring base affixed to the first sidewall adjacent its lower edge and a return spring affixed between the spring base at one end and affixed to the horizontal platform and its opposite end; and (m) a tie bar having a central collar with a spring therein, a first tie shaft supported at one end of the spring and connected to the rear end of the pin supporting the first roller at its opposite end, and a second tie shaft supported at the opposite end of the spring and connected to the rear end of the pin supporting the second roller at its opposite end; (n) whereby, the housing is positioned on a water bucket so that the lower edges of the first and second sidewalls are adjacent the water bucket and the strands of a wet mop are positioned first above the housing to a location between the rollers and a downward force on the handle causes the movable platform to move downwardly which in turn causes the first and second arms to cause the pins supporting the rollers to respectively move along the first and second channels in the first sidewall where the tie bar causes the opposite ends of the pins supporting the rollers to move along the first and second channels in the second sidewall, thereby causing the rollers to come together and rollably move along the strands of the mop to wring water out of the mop, the water going through the open bottom of this housing and through the openings in the front wall into the water bucket, and when the downward force is released, the return spring causes the movable platform, the rollers and their respective pins to return to their starting position.

Defined broadly, the present invention is a single action mop wringer, comprising: (a) a housing including a front wall having a multiplicity of openings, a rear wall, a first sidewall having a lower edge, an upper edge and a parallel oppositely disposed second sidewall having a lower edge and an upper edge, and an open top and open bottom; (b) a first channel formed into the first sidewall, the first channel having a first arcuate section extending in one direction toward the rear wall and adjacent the upper edge, and extending in the opposite direction to a first vertically aligned second section terminating at a distance above the lower edge of the first sidewall; (c) a second channel formed into the first sidewall, the second channel having a second arcuate section extending in one direction toward the front wall and the upper edge, and extending in the opposite direction to a second vertically aligned section terminating at a distance above the lower edge of the first sidewall, the first vertically aligned second section and the second vertically aligned second section being spaced apart and parallel to the one and having the same vertical distance from their respective arcuate sections to the distance above the lower edge of the first sidewall; (d) a first channel formed into the second sidewall, the first channel in the second sidewall being the same shape as and parallel to the first channel formed into the first sidewall, the first channel formed into the second sidewall having a corresponding arcuate section and a corresponding vertical section; (e) a second channel formed into the second sidewall, the second channel in the second sidewall being the same shape as and parallel to the second channel formed into the first sidewall, the second channel formed into the second sidewall having a corresponding arcuate section and a corresponding vertical section; (f) a first roller rotatably supported on a pin and adjacent the upper edge of the first and second sidewalls, the pin having a front end and extending through the first arcuate section of the first channel in the first sidewall and a rear end extending through a first arcuate section in the first channel in the second sidewall; (g) a second roller spaced from and parallel to the first roller, the second roller rotatably supported on a pin and adjacent the upper edge of first and second sidewalls, the pin having a front end extending through the second arcuate section of the second channel in the first sidewall and a rear end extending through a second arcuate section in the second channel in the second sidewall; (h) a horizontally aligned movable platform disposed adjacent the first sidewall, the movable platform having a first bracket with an opening adjacent one of its ends and a parallel oppositely disposed second bracket with an opening adjacent its opposite end; (i) a first arm having an elongated shaft and with a base at one end having a pair of oppositely disposed pins which are inserted in and rotatably supported by the opening in the first bracket and a collar with an opening at the opposite end of the shaft, the opening of the collar inserted onto the first end of the pin supporting the first roller; (j) a second arm having an elongated shaft and a base at one end having a pair of oppositely disposed pins which are inserted in and rotatably supported by the opening in the second bracket and a collar with an opening at the opposite end of the shaft, the opening of the collar inserted onto the first end of the pin supporting the second roller; (k)

the movable platform having a centrally disposed handle base, an elongated handle supported in the handle base at one end and having a grip member at its opposite end; (l) a return spring within a housing affixed to the first sidewall adjacent its upper edge, the return spring affixed at one end to the horizontal platform; and (m) a tie bar having a central collar with a spring therein, a first tie shaft supported at one end of the spring and connected to the rear end of the pin supporting the first roller at its opposite end, and a second tie shaft supported at the opposite end of the spring and connected to the rear end of the pin supporting the second roller at its opposite end; (n) whereby, the housing is positioned on a water bucket so that the lower edges of the first and second sidewalls are adjacent the water bucket and the strands of a wet mop are positioned first above the housing to a location between the rollers and a downward force on the handle causes the movable platform to move downwardly which in turn causes the first and second arms to cause the pins supporting the roller to respectively move along the first and second channels in the first sidewall where the tie bar causes the opposite ends of the pins supporting the rollers to move along the first and second channels in the second sidewall, thereby causing the rollers to come together and rollably move along the strands of the mop to wring water out of the mop, the water going through the open bottom of this housing and through the openings in the front wall into the water bucket, and when the downward force is released, the return spring causes the movable platform, the rollers and their respective pins to return to their starting position.

Defined more broadly, the present invention is a single action mop wringer, comprising: (a) a housing including a front wall having a multiplicity of openings, a rear wall, a first sidewall having a lower edge, an upper edge and a parallel oppositely disposed second sidewall having a lower edge and an upper edge, and an open top and open bottom; (b) a first channel formed into the first sidewall, the first channel having a first arcuate section extending in one direction toward the rear wall and adjacent the upper edge, and extending in the opposite direction to a first vertically aligned second section terminating at a distance above the lower edge of the first sidewall; (c) a second channel formed into the first sidewall, the second channel having a second arcuate section extending in one direction toward the front wall and the upper edge, and extending in the opposite direction to a second vertically aligned section terminating at a distance above the lower edge of the first sidewall, the first vertically aligned second section and the second vertically aligned second section being spaced apart and parallel to the one and having the same vertical distance from their respective arcuate sections to the distance above the lower edge of the first sidewall; (d) a first channel formed into the second sidewall, the first channel in the second sidewall being the same shape as and parallel to the first channel formed into the first sidewall, the first channel formed into the second sidewall having a corresponding arcuate section and a corresponding vertical section; (e) a second channel formed into the second sidewall, the second channel in the second sidewall being the same shape as and parallel to the second channel formed into the first sidewall, the second channel formed into the second sidewall having a corresponding arcuate section and a corresponding vertical section; (f) a first roller rotatably supported on a pin and adjacent the upper edge of the first and second sidewalls, the pin having a front end and extending through the first arcuate section of the first channel in the first sidewall and a rear end extending through a first arcuate section in the first channel in the second sidewall; (g) a second roller spaced from and parallel to the first roller, the second roller rotatably supported on a pin and adjacent the upper edge of first and second sidewalls, the pin having a front end extending through the second arcuate section of the second channel in the first sidewall and a rear end extending through a second arcuate section in the second channel in the second sidewall; (h) a movable yoke assembly disposed adjacent the first sidewall, the yoke assembly having a Y-shaped section composed of a first section having a pair of aligned walls, a gap therebetween and a pair of aligned openings in the walls, a second oppositely disposed section having a pair of aligned walls, a gap therebetween and a pair of aligned openings in the walls, a base of the yoke forming the vertical portion of the Y, and a handle base disposed between the first and second section; (i) a first arm having an elongated shaft and with a base at one end having a pair of oppositely disposed pins which are inserted in and rotatably supported by the openings in the first section of the yoke assembly and a collar with an opening at the opposite end of the shaft, the opening of the collar inserted onto the first end of the pin supporting the first roller; (j) a second arm having an elongated shaft and a base at one end having a pair of oppositely disposed pins which are inserted in and rotatably supported by the openings in the second section of the yoke assembly and a collar with an opening at the opposite end of the shaft, the opening of the collar inserted onto the first end of the pin supporting the second roller; (k) the movable yoke assembly having an elongated handle supported in the handle base of the yoke assembly at one end and having a grip member at its opposite end; (l) a spring base affixed to the first sidewall adjacent its lower edge and a return spring affixed between the spring base at one end and affixed to the base of the yoke assembly at its opposite end; and (m) a tie bar having a central collar with a spring therein, a first tie shaft supported at one end of the spring and connected to the rear end of the pin supporting the first roller at its opposite end, and a second tie shaft supported at the opposite end of the spring and connected to the rear end of the pin supporting the second roller at its opposite end; (n) whereby, the housing is positioned on a water bucket so that the lower edges of the first and second sidewalls are adjacent the water bucket and the strands of a wet mop are positioned first above the housing to a location between the rollers and a downward force on the handle causes the movable yoke assembly to move downwardly which in turn causes the first and second arms to cause the pins supporting the rollers to respectively move along the first and second channels in the first sidewall where the tie bar causes the opposite ends of the pins supporting the rollers to move along the first and second channels in the second sidewall, thereby causing the rollers to come together and rollably move along the strands of the mop to wring water out of the mop, the water going through the open bottom of this housing and through the openings in the front wall into the water bucket, and when the downward force is released, the return spring causes the movable yoke assembly, the rollers and their respective pins to return to their starting position.

Defined even more broadly, the present invention is a single action mop wringer, comprising: (a) a housing including a front wall, a rear wall, a first sidewall having a lower edge, an upper edge and a parallel oppositely disposed second sidewall having a lower edge and an upper edge, and an open top and open bottom;

(b) a first channel formed into the first sidewall, the first channel having a first arcuate section adjacent the upper edge, and extending in the opposite direction to a first vertically aligned second section terminating at a distance above the lower edge of the first sidewall; (c) a second channel formed into the first sidewall, the second channel having a second arcuate section extending in one direction toward the front wall and the upper edge, and extending in the opposite direction to a second vertically aligned section terminating at a distance above the lower edge of the first sidewall, the first vertically aligned second section and the second vertically aligned second section being spaced apart and parallel to the one and having the same vertical distance from their respective arcuate sections to the distance above the lower edge of the first sidewall; (d) a first channel formed into the second sidewall, the first channel in the second sidewall being the same shape as and parallel to the first channel formed into the first sidewall, the first channel formed into the second sidewall having a corresponding arcuate section and a corresponding vertical section; (e) a second channel formed into the second sidewall, the second channel in the second sidewall being the same shape as and parallel to the second channel formed into the first sidewall, the second channel formed into the second sidewall having a corresponding arcuate section and a corresponding vertical section; (f) a first roller rotatably supported on a pin and adjacent the upper edge of the first and second sidewalls, the pin having a front end and extending through the first arcuate section of the first channel in the first sidewall and a rear end extending through a first arcuate section in the first channel in the second sidewall; (g) a second roller spaced from and parallel to the first roller, the second roller rotatably supported on a pin and adjacent the upper edge of first and second sidewalls, the pin having a front end extending through the second arcuate section of the second channel in the first sidewall and a rear end extending through a second arcuate section in the second channel in the second sidewall; (h) a horizontally aligned movable platform disposed adjacent the first sidewall, the movable platform having a first support means adjacent one end and an oppositely disposed second support means at its opposite end; (i) a first arm having an elongated shaft and with means at one end to be rotatably supported by the first means in the platform and means at the opposite end of the shaft to be supported on the pin of the first roller; (j) a second arm having an elongated shaft with means at one end to be rotatably supported by the second support means in the platform and means at the opposite end of the shaft to be supported on the pin of the second roller; (k) a handle supported on the movable platform; (l) a spring base affixed to the first sidewall adjacent its lower edge and a return spring affixed between the spring base at one end and affixed to the horizontal platform and its opposite end; and (m) a tie bar having means to compressibly support a first shaft and a second shaft, the shafts respectively connected to the rear end of the pin support of the first and second rollers; (n) whereby, the housing is positioned on a water bucket so that the lower edges of the first and second sidewalls are adjacent the water bucket and the strands of a wet mop are positioned first above the housing to a location between the rollers and a downward force on the handle causes the movable platform to move downwardly which in turn causes the first and second arms to cause the pins supporting the rollers to respectively move along the first and second channels in the first sidewall where the tie bar causes the opposite ends of the pins supporting the rollers to move along the first and second channels in the second sidewall, thereby causing the rollers to come together and rollably move along the strands of the mop to wring water out of the mop, the water going through the open bottom of this housing and through the openings in the front wall into the water bucket, and when the downward force is released, the return spring causes the movable platform, the rollers and their respective pins to return to their starting position.

Defined even more broadly, the present invention is a single action mop wringer, comprising: (a) a housing including a front wall, a rear wall, a first sidewall having a lower edge, an upper edge and a parallel oppositely disposed second sidewall having a lower edge and an upper edge, and an open top and open bottom; (b) a first channel formed into the first sidewall, the first channel having a first arcuate section extending in one direction toward the rear wall and adjacent the upper edge, and extending in the opposite direction to a first vertically aligned second section terminating at a distance above the lower edge of the first sidewall; (c) a second channel formed into the first sidewall, the second channel having a second arcuate section extending in one direction toward the front wall and the upper edge, and extending in the opposite direction to a second vertically aligned section terminating at a distance above the lower edge of the first sidewall, the first vertically aligned second section and the second vertically aligned second section being spaced apart and parallel to the one and having the same vertical distance from their respective arcuate sections to the distance above the lower edge of the first sidewall; (d) a first channel formed into the second sidewall, the first channel in the second sidewall being the same shape as and parallel to the first channel formed into the first sidewall, the first channel formed into the second sidewall having a corresponding arcuate section and a corresponding vertical section; (e) a second channel formed into the second sidewall, the second channel in the second sidewall being the same shape as and parallel to the second channel formed into the first sidewall, the second channel formed into the second sidewall having a corresponding arcuate section and a corresponding vertical section; (f) a first roller rotatably supported on a pin and adjacent the upper edge of the first and second sidewalls, the pin having a front end and extending through the first arcuate section of the first channel in the first sidewall and a rear end extending through a first arcuate section in the first channel in the second sidewall; (g) a second roller spaced from and parallel to the first roller, the second roller rotatably supported on a pin and adjacent the upper edge of first and second sidewalls, the pin having a front end extending through the second arcuate section of the second channel in the first sidewall and a rear end extending through a second arcuate section in the second channel in the second sidewall; (h) a horizontally aligned movable platform disposed adjacent the first sidewall, the movable platform having a first support means adjacent one end and an oppositely disposed second support means at its opposite end; (i) a first arm having an elongated shaft and with means at one end to be rotatably supported by the first means in the platform and means at the opposite end of the shaft to be supported on the pin of the first roller; (j) a second arm having an elongated shaft with means at one end to be rotatably supported by the second support means in the platform and means at the opposite end of the shaft to be supported on the pin of the second roller; (k) a handle supported on the movable platform; (l) a return spring within a housing affixed to the first sidewall adjacent its upper edge, the return spring affixed at one end to the horizontal platform; and (m) a tie bar having means to compressibly support a first shaft and a second shaft, the shafts respectively connected to the rear end of the pin support of the first and second rollers; (n) whereby, the housing is positioned on a water bucket so that the lower edges of the first and second sidewalls are adjacent the water bucket and the strands of a wet mop are positioned first above the housing to a location between the rollers and a downward force on the handle causes the movable platform to move downwardly which in turn causes the first and second arms to cause the pins supporting the rollers to respectively move along the first and second channels in the first sidewall where the tie bar causes the opposite ends of the pins supporting the rollers to move along the first and second channels in the second sidewall, thereby causing the rollers to come together and rollably move along the strands of the mop to wring water out of the mop, the water going through the open bottom of this housing and through the openings in the front wall into the water bucket, and when the downward force is released, the return spring causes the movable platform, the rollers and their respective pins to return to their starting position.

Defined even more broadly, the present invention is a single action mop wringer, comprising: (a) a housing including a front wall, a rear wall, a first sidewall having a lower edge, an upper edge and a parallel oppositely disposed second sidewall having a lower edge and an upper edge, and an open top and open bottom; (b) a first channel formed into the first sidewall, the first channel having a first arcuate section extending in one direction toward the rear wall and adjacent the upper edge, and extending in the opposite direction to a first vertically aligned second section terminating at a distance above the lower edge of the first sidewall; (c) a second channel formed into the first sidewall, the second channel having a second arcuate section extending in one direction toward the front wall and the upper edge, and extending in the opposite direction to a second vertically aligned section terminating at a distance above the lower edge of the first sidewall, the first vertically aligned second section and the second vertically aligned second section being spaced apart and parallel to the one and having the same vertical distance from their respective arcuate sections to the distance above the lower edge of the first sidewall; (d) a first channel formed into the second sidewall, the first channel in the second sidewall being the same shape as and parallel to the first channel formed into the first sidewall, the first channel formed into the second sidewall having a corresponding arcuate section and a corresponding vertical section; (e) a second channel formed into the second sidewall, the second channel in the second sidewall being the same shape as and parallel to the second channel formed into the first sidewall, the second channel formed into the second sidewall having a corresponding arcuate section and a corresponding vertical section; (f) a first roller rotatably supported on a pin and adjacent the upper edge of the first and second sidewalls, the pin having a front end and extending through the first arcuate section of the first channel in the first sidewall and a rear end extending through a first arcuate section in the first channel in the second sidewall; (g) a second roller spaced from and parallel to the first roller, the second roller rotatably supported on a pin and adjacent the upper edge of first and second sidewalls, the pin having a front end extending through the second arcuate section of the second channel in the first sidewall and a rear end extending through a second arcuate section in the second channel in the second sidewall; (h) a movable yoke assembly disposed adjacent the first sidewall, the yoke assembly having a Y-shaped section composed of a first section having a pair of aligned walls, a gap therebetween and a pair of aligned openings in the walls, a second oppositely disposed section having a pair of aligned walls, a gap therebetween and a pair of aligned openings in the walls, a base of the yoke forming the vertical portion of the Y, and a handle base disposed between the first and second section; (i) a first arm having an elongated shaft and with means at one end to be rotatably supported by the openings in the first section of the yoke assembly and means at the opposite end of the shaft to be supported on the pin of the first roller; (j) a second arm having an elongated shaft with means at one end to be rotatably supported by the openings in the second section of the yoke assembly and means at the opposite end of the shaft to be supported on the pin of the second roller; (k) a handle supported on the handle base of the yoke assembly; (l) a spring base affixed to the first sidewall adjacent its lower edge and a return spring affixed between the spring base at one end and affixed to the base of the yoke assembly and its opposite end; and (m) a tie bar having means to compressibly support a first shaft and a second shaft, the shafts respectively connected to the rear end of the pin support of the first and second rollers; (n) whereby, the housing is positioned on a water bucket so that the lower edges of the first and second sidewalls are adjacent the water bucket and the strands of a wet mop are positioned first above the housing to a location between the rollers and a downward force on the handle causes the movable platform to move downwardly which in turn causes the first and second arms to cause the pins supporting the rollers to respectively move along the first and second channels in the first sidewall where the tie bar causes the opposite ends of the pins supporting the rollers to move along the first and second channels in the second sidewall, thereby causing the rollers to come together and rollably move along the strands of the mop to wring water out of the mop, the water going through the open bottom of this housing and through the openings in the front wall into the water bucket, and when the downward force is released, the return spring causes the movable yoke assembly, the rollers and their respective pins to return to their starting position.

Defined even more broadly, the present invention is a single action mop wringer comprising: (a) a housing including at least a first sidewall having a lower edge and an upper edge and a parallel oppositely disposed second sidewall having a lower edge and an upper edge and an open top; (b) a first track formed into the first sidewall and a first track formed into the second sidewall, the tracks being the same shape and parallel to one another; (c) a second track formed into the first sidewall, the second track spaced apart from the first track and being a mirror image of the first track; (d) a second track formed into the second sidewall, the second track spaced apart from the first track and being a mirror image of the first track, the second track being the same shape and parallel to the second track in the first sidewall; (e) a first roller rotatably supported on a pin and adjacent the upper edge of the first and second sidewalls, the pin having a front end extending through the first track in the first sidewall and a rear end extending through the first track in the second sidewall; (f) a second roller rotatably supported on a pin and adjacent the upper edge of the first and second sidewalls, the pin having a front end extending through the second track in the first sidewall and a rear end extending through the second track in the second sidewall; (g) the shape of the tracks formed so that the rollers are spaced apart when at the location adjacent the top of the sidewalls such that when the rollers are caused to move downwardly along the tracks, a portion of the tracks in the first sidewall being vertically aligned and parallel to each other are spaced by a given distance and a portion of the tracks in the second sidewall being vertically aligned and parallel to each other are separated by the same distance as the distance between the vertically aligned portions of the tracks in the first sidewall; (h) a horizontally aligned movable platform disposed adjacent the first sidewall and having a handle supported thereon, and rotatable means to support the horizontal platform on the front ends of the pin supporting the first roller and the pin supporting the second roller; (i) means to movably interconnect the rear ends of the pin supporting the first roller and the pin supporting the second roller; and (j) return spring means connected to the horizontally aligned movable platform; (k) whereby, the housing is positioned on a water bucket so that the lower edges of the first and second sidewalls are adjacent the water bucket and the strands of a wet mop are positioned first above the housing to a location between the rollers and a downward force on the handle causes the movable platform to move downwardly which in turn causes the rotatable means which support the platform to cause the pins supporting the rollers to respectively move along the first and second tracks in the first sidewall where the means to movably interconnect the rear end of the pins causes the pins supporting the rollers to move along the first and second tracks in the second sidewall, thereby causing the rollers to come together and rollably move along the strands of the mop to wring water out of the mop, the water going through the housing into the water bucket, and when the downward force is released, the return spring causes the movable yoke assembly, the rollers and their respective pins to return to their starting position.

Defined even more broadly, the present invention is a single action mop wringer comprising: (a) a housing including at least a first sidewall having a lower edge and an upper edge and a parallel oppositely disposed second sidewall having a lower edge and an upper edge and an open top; (b) a first track formed into the first sidewall and a first track formed into the second sidewall, the tracks being the same shape and parallel to one another; (c) a second track formed into the first sidewall, the second track spaced apart from the first track and being a mirror image of the first track; (d) a second track formed into the second sidewall, the second track spaced apart from the first track and being a mirror image of the first track, the second track being the same shape and parallel to the second track in the first sidewall; (e) a first roller rotatably supported on a pin and adjacent the upper edge of the first and second sidewalls, the pin having a front end extending through the first track in the first sidewall and a rear end extending through the first track in the second sidewall; (f) a second roller rotatably supported on a pin and adjacent the upper edge of the first and second sidewalls, the pin having a front end extending through the second track in the first sidewall and a rear end extending through the second track in the second sidewall; (g) the shape of the tracks formed so that the rollers are spaced apart when at the location adjacent the top of the sidewalls such that when the rollers are caused to move downwardly along the tracks, a portion of the tracks in the first sidewall being vertically aligned and parallel to each other are spaced by a given distance and a portion of the tracks in the second sidewall being vertically aligned and parallel to each other are separated by the same distance as the distance between the vertically aligned portions of the tracks in the first sidewall; (h) a movable yoke assembly disposed adjacent the first sidewall, the yoke assembly having a handle supported thereon and oppositely extending arms, rotatable means to support the yoke assembly on the oppositely extending arms and also on the front ends of the pin supporting the first roller and the pin supporting the second roller; (i) means to movably interconnect the rear ends of the pin supporting the first roller and the in supporting the second roller, and (j) return spring means connected to the movable yoke assembly; (k) whereby, the housing is positioned on a water bucket so that the lower edges of the first and second sidewalls are adjacent the water bucket and the strands of a wet mop are positioned first above the housing to a location between the rollers and a downward force on the handle causes the yoke assembly to move downwardly which in turn causes the rotatable means which support the yoke assembly to cause the pins supporting the rollers to respectively move along the first and second tracks in the first sidewall where the means to movably interconnect the rear end of the pins causes the pins supporting the rollers to move along the first and second tracks in the second sidewall, thereby causing the rollers to come together and rollably move along the strands of the mop to wring water out of the mop, the water going through the housing into the water bucket, and when the downward force is released, the return spring causes the movable yoke assembly, the rollers and their respective pins to return to their starting position.

Defined even more broadly, the present invention is a single action mop wringer comprising: (a) a housing including at least a first sidewall having a lower edge and an upper edge and a parallel oppositely disposed second sidewall having a lower edge and an upper edge and an open top; (b) a first track formed into the first sidewall and a first track formed into the second sidewall, the tracks being the same shape and parallel to one another; (c) a second track formed into the first sidewall, the second track spaced apart from the first track and being a mirror image of the first track; (d) a second track formed into the second sidewall, the second track spaced apart from the first track and being a mirror image of the first track, the second track being the same shape and parallel to the second track in the first sidewall; (e) a first roller rotatably supported on a pin and adjacent the upper edge of the first and second sidewalls, the pin having a front end extending through the first track in the first sidewall and a rear end extending through the first track in the second sidewall; (f) a second roller rotatably supported on a pin and adjacent the upper edge of the first and second sidewalls, the pin having a front end extending through the second track in the first sidewall and a rear end extending through the second track in the second sidewall; (g) the shape of the tracks formed so that the rollers are spaced apart when at the location adjacent the top of the sidewalls such that when the rollers are caused to move downwardly along the tracks, a portion of the tracks in the first sidewall being vertically aligned and parallel to each other are spaced by a given distance and a portion of the tracks in the second sidewall being vertically aligned and parallel to each other are separated by the same distance as the distance between the vertically aligned portions of the tracks in the first sidewall; (h) activation means comprising a handle and oppositely disposed movable arms, which respectively connect the activation means to the front end of the pin supporting the first roller and the front end of the pin rotatably supporting the second roller; (i) means to movably interconnect the rear ends of the pin supporting the first roller and the in supporting the second roller, and (j) return spring means connected to the activation means; (k) whereby, the housing is positioned on a water bucket so that the lower edges of the first and second sidewalls are adjacent the water bucket and the strands of a wet mop are positioned first above the housing to a location between the rollers and a downward force on the handle causes the activation means to move downwardly which in turn causes the movable arms to cause the pins supporting the rollers to respectively move along the first and second tracks in the first sidewall where the means to movably interconnect the rear end of the pins causes the pins supporting the rollers to move along the first and second tracks in the second sidewall, thereby causing the rollers to come together and rollably move along the strands of the mop to wring water out of the mop, the water going through the housing into the water bucket, and when the downward force is released, the return spring causes the activation means, the rollers and their respective pins to return to their starting position.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A single action mop wringer, comprising:

a. a housing including a front wall having a multiplicity of openings, a rear wall, a first sidewall having a lower edge, an upper edge and a parallel oppositely disposed second sidewall having a lower edge and upper edge, and an open top and open bottom;

b. a first channel formed into said first sidewall, the first channel having a first arcuate section extending in one direction toward said rear wall and adjacent the upper edge, and extending in said opposite direction to a first vertically aligned second section terminating at a distance above the lower edge of said first sidewall;

c. a second channel formed into said first sidewall, the second channel having a second arcuate section extending in one direction toward said front wall and said upper edge, and extending in said opposite direction to a second vertically aligned section terminating at a distance above the lower edge of said first sidewall, the first vertically aligned second section and the second vertically aligned second section being spaced apart and parallel to each other and having the same vertical distance from their respective arcuate sections to the distance above the lower edge of said first sidewall;

d. a first channel formed into said second sidewall, the first channel in said second sidewall being the same shape as and parallel to the first channel formed into said first sidewall, the first channel formed into said second sidewall having a corresponding arcuate section and a corresponding vertical section;

e. a second channel formed into said second sidewall, the second channel in said second sidewall being the same shape as and parallel to the second channel formed into said first sidewall, the second channel formed into said second sidewall having a corresponding arcuate section and a corresponding vertical section;

f. a first roller rotatably supported on a pin and adjacent said upper edge of said first and second sidewalls, the pin having a front end and extending through said first arcuate section of said first channel in said first sidewall and a rear end extending through a first arcuate section in said first channel in said second sidewall;

g. a second roller spaced from and parallel to said first roller, said second roller rotatably supported on a pin and adjacent said upper edge of said first and second sidewalls, the pin having a front end extending through said second arcuate section of said second channel in said first sidewall and a rear end extending through a second arcuate section in said second channel in said second sidewall;

h. a horizontally aligned movable platform disposed adjacent said first sidewall, the movable platform having a first bracket with an opening adjacent one of its ends and a parallel oppositely disposed second bracket with an opening adjacent its opposite end;

i. a first arm having an elongated shaft and with a base at one end having a pair of oppositely disposed pins which are inserted in and rotatably supported by the opening in said first bracket and a collar with an opening at the opposite end of the shaft, the opening of the collar inserted onto said first end of said pin supporting said first roller;

j. a second arm having an elongated shaft and a base at one end having a pair of oppositely disposed pins which are inserted in and rotatably supported by the opening in said second bracket and a collar with an opening at the opposite end of the shaft, the opening of the collar inserted onto said first end of said pin supporting said second roller;

k. said movable platform having a centrally disposed handle base, an elongated handle supported in said handle base at one end and having a grip member at its opposite end;

l. a spring base affixed to said first sidewall adjacent its lower edge and a return spring affixed between said spring base at one end and affixed to said horizontal platform and its opposite end; and m. a tie bar having a central collar with a spring therein, a first tie shaft supported at one end of said spring and connected to said rear end of said pin supporting said first roller at its opposite end, and a second tie shaft supported at the opposite end of said spring and connected to said rear end of said pin supporting said second roller at its opposite end;

n. whereby, said housing is positioned on a water bucket so that the lower edges of the first and second sidewalls are adjacent the water bucket and the strands of a wet mop are positioned first above the housing to a location between said rollers and a downward force on said handle causes said movable platform to move downwardly which in turn causes said first and second arms to cause said pins supporting said rollers to respectively move along said first and second channels in said first sidewall where the tie bar causes the opposite ends of said pins supporting said rollers to move along the first and second channels in said second sidewall, thereby causing said rollers to come together and rollably move along the strands of the mop to wring water out of the mop, the water going through the open bottom of this housing and through the openings in the front wall into the water bucket, and when the downward force is released, the return spring causes the movable platform, the rollers and their respective pins to return to their starting position.

2. A single action mop wringer, comprising:

a. a housing including a front wall, a rear wall, a first sidewall having a lower edge, an upper edge and a parallel oppositely disposed second sidewall having a lower edge and an upper edge, and an open top and open bottom;

b. a first channel formed into said first sidewall, the first channel having a first arcuate section extending in one direction toward said rear wall and adjacent the upper edge, and extending in said opposite direction to a first vertically aligned second section terminating at a distance above the lower edge of said first sidewall;

c. a second channel formed into said first sidewall, the second channel having a second arcuate section extending in one direction toward said front wall and said upper edge, and extending in said opposite direction to a second vertically aligned section terminating at a distance above the lower edge of said first sidewall, the first vertically aligned second section and the second vertically aligned second section being spaced apart and parallel to each other and having the same vertical distance from their respective arcuate sections to the distance above the lower edge of said first sidewall;

d. a first channel formed into said second sidewall, the first channel in said second sidewall being the same shape as and parallel to the first channel formed into said first sidewall, the first channel formed into said second sidewall having a corresponding arcuate section and a corresponding vertical section;

e. a second channel formed into said second sidewall, the second channel in said second sidewall being the same shape as and parallel to the second channel formed into said first sidewall, the second channel formed into said second sidewall having a corresponding arcuate section and a corresponding vertical section;

f. a first roller rotatably supported on a pin and adjacent said upper edge of said first and second sidewalls, the pin having a front end and extending through said first arcuate section of said first channel in said first sidewall and a rear end extending through a first arcuate section in said first channel in said second sidewall;

g. a second roller spaced from and parallel to said first roller, said second roller rotatably supported on a pin and adjacent said upper edge of said first and second sidewalls, the pin having a front end extending through said second arcuate section of said second channel in said first sidewall and a rear end extending through a second arcuate section in said second channel in said second sidewall;

h. a horizontally aligned movable platform disposed adjacent said first sidewall, the movable platform having a first support means adjacent one end and an oppositely disposed second support means at its opposite end;

i. a first arm having an elongated shaft and with means at one end to be rotatably supported by the first means in the platform and means at the opposite end of the shaft to be supported on the pin of said first roller;

j. a second arm having an elongated shaft with means at one end to be rotatably supported by the second support means in the platform and means at the opposite end of the shaft to be supported on the pin of said second roller;

k. a handle supported on said movable platform;

l. a spring base affixed to said first sidewall adjacent its lower edge and a return spring affixed between said spring base at one end and affixed to said horizontal platform and its opposite end; and m. a tie bar having means to compressibly support a first shaft and a second shaft, the shafts respectively connected to the rear end of said pin support of said first and second rollers;

n. whereby, said housing is positioned on a water bucket so that the lower edges of the first and second sidewalls are adjacent the water bucket and the strands of a wet mop are positioned first above the housing to a location between said rollers and a downward force on said handle causes said movable platform to move downwardly which in turn causes said first and second arms to cause said pins supporting said rollers to respectively move along said first and second channels in said first sidewall where the tie bar causes the opposite ends of said pins supporting said rollers to move along the first and second channels in said second sidewall, thereby causing said rollers to come together and rollably move along the strands of the mop to wring water out of the mop, the water going through the open bottom of this housing and through the openings in the front wall into the water bucket, and when the downward force is released, the return spring causes the movable platform, the rollers and their respective pins to return to their starting position.

3. A single action mop wringer comprising:

a. a housing including at least a first sidewall having a lower edge and an upper edge and a parallel oppositely disposed second sidewall having a lower edge and an upper edge and an open top;

b. a first track formed into said first sidewall and a first track formed into said second sidewall, the tracks being the same shape and parallel to one another;

c. a second track formed into said first sidewall, the second track spaced apart from the first track and being a mirror image of the first track;

d. a second track formed into said second sidewall, the second track spaced apart from the first track and being a mirror image of the first track, the second track being the same shape and parallel to the second track in the first sidewall;

e. a first roller rotatably supported on a pin and adjacent said upper edge of said first and second sidewalls, the pin having a front end extending through said first track in said first sidewall and a rear end extending through said first track in said second sidewall;

f. a second roller rotatably supported on a pin and adjacent said upper edge of said first and second sidewalls, the pin having a front end extending through said second track in said first sidewall and a rear end extending through said second track in said second sidewall;

g. the shape of the tracks formed so that the rollers are spaced apart when at the location adjacent the top of the sidewalls such that when the rollers are caused to move downwardly along the tracks, a portion of the tracks in said first sidewall being vertically aligned and parallel to each other are spaced by a given distance and a portion of the tracks in said second sidewall being vertically aligned and parallel to each other are separated by the same distance as the distance between the vertically aligned portions of the tracks in the first sidewall;

h. a horizontally aligned movable platform disposed adjacent said first sidewall and having a handle supported thereon, and rotatable means to support the horizontal platform on said front ends of said pin supporting said first roller and said pin supporting said second roller;

i. means to movably interconnect the rear ends of said pin supporting said first roller and said pin supporting said second roller; and j. return spring means connected to said horizontally aligned movable platform;

k. whereby, said housing is positioned on a water bucket so that the lower edges of the first and second sidewalls are adjacent the water bucket and the strands of a wet mop are positioned first above the housing to a location between said rollers and a downward force on said handle causes said movable platform to move downwardly which in turn causes said rotatable means which support the platform to cause said pins supporting said rollers to respectively move along said first and second tracks in said first sidewall where the means to movably interconnect the rear end of the pins causes said pins supporting said rollers to move along the first and second tracks in said second sidewall, thereby causing said rollers to come together and rollably move along the strands of the mop to wring water out of the mop, the water going through the housing into the water bucket, and when the downward force is released, the return spring causes the movable yoke assembly, the rollers and their respective pins to return to their starting position.

4. The single action mop ringer in accordance with claim 3, wherein said return spring is positioned below said horizontal platform.

5. A single action mop wringer comprising:

a. a housing including at least a first sidewall having a lower edge and an upper edge and a parallel oppositely disposed second sidewall having a lower edge and an upper edge and an open top;

b. a first track formed into said first sidewall and a first track formed into said second sidewall, the tracks being the same shape and parallel to one another;

c. a second track formed into said first sidewall, the second track spaced apart from the first track and being a mirror image of the first track;

d. a second track formed into said second sidewall, the second track spaced apart from the first track and being a mirror image of the first track, the second track being the same shape and parallel to the second track in the first sidewall;

e. a first roller rotatably supported on a pin and adjacent said upper edge of said first and second sidewalls, the pin having a front end extending through said first track in said first sidewall and a rear end extending through said first track in said second sidewall;

f. a second roller rotatably supported on a pin and adjacent said upper edge of said first and second sidewalls, the pin having a front end extending through said second track in said first sidewall and a rear end extending through said second track in said second sidewall;

g. the shape of the tracks formed so that the rollers are spaced apart when at the location adjacent the top of the sidewalls such that when the rollers are caused to move downwardly along the tracks, a portion of the tracks in said first sidewall being vertically aligned and parallel to each other are spaced by a given distance and a portion of the tracks in said second sidewall being vertically aligned and parallel to each other are separated by the same distance as the distance between the vertically aligned portions of the tracks in the first sidewall;

h. activation means comprising a handle and oppositely disposed movable arms, which respectively connect the activation means to the front end of the pin supporting said first roller and the front end of the pin rotatably supporting said second roller;

i. means to movably interconnect the rear ends of said pin supporting said first roller and said pin supporting said second roller, and j. return spring means connected to said activation means;

k. whereby, said housing is positioned on a water bucket so that the lower edges of the first and second sidewalls are adjacent the water bucket and the strands of a wet mop are positioned first above the housing to a location between said rollers and a downward force on said handle causes said activation means to move downwardly which in turn causes said movable arms to cause said pins supporting said rollers to respectively move along said first and second tracks in said first sidewall where the means to movably interconnect the rear end of the pins causes said pins supporting said rollers to move along the first and second tracks in said second sidewall, thereby causing said rollers to come together and rollably move along the strands of the mop to wring water out of the mop, the water going through the housing into the water bucket, and when the downward force is released, the return spring causes the activation means, the rollers and their respective pins to return to their starting position.

6. The single action mop ringer in accordance with claim 5, wherein said return spring is positioned below said activation means.

* * * * *